US006267797B1

(12) United States Patent
Östlund et al.

(10) Patent No.: US 6,267,797 B1
(45) Date of Patent: Jul. 31, 2001

(54) SINTERING METHOD

(75) Inventors: Åke Östlund, Hägersten; Leif Åkesson, Älvsjö, both of (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/214,621

(22) PCT Filed: Jul. 7, 1997

(86) PCT No.: PCT/SE97/01231

§ 371 Date: Apr. 1, 1999

§ 102(e) Date: Apr. 1, 1999

(87) PCT Pub. No.: WO98/02396

PCT Pub. Date: Jan. 22, 1998

(30) Foreign Application Priority Data

Jul. 11, 1996 (SE) ..... 9602750

(51) Int. Cl.[7] ..... C22C 1/05
(52) U.S. Cl. ..... 75/240; 429/18; 429/25
(58) Field of Search ..... 428/469; 419/18, 419/25; 75/240

(56) References Cited

U.S. PATENT DOCUMENTS

| | | | | |
|---|---|---|---|---|
| 4,282,289 | | 8/1981 | Kullander et al. | 428/457 |
| 4,911,989 | | 3/1990 | Minoru et al. | 428/547 |
| 5,279,901 | * | 1/1994 | Akerman et al. | 428/469 |
| 5,380,408 | | 1/1995 | Svensson | 204/129.1 |
| 5,453,241 | | 9/1995 | Akerman et al. | 419/14 |

FOREIGN PATENT DOCUMENTS

| | | |
|---|---|---|
| 88-053269 | 3/1988 | (JP) . |
| 88-060279 | 3/1988 | (JP) . |
| 88-060280 | 11/1988 | (JP) . |

OTHER PUBLICATIONS

Patent Abstracts of Japan, abstract of JP,A,60–110840 (Sumitomo Denki Kogyo K.K.), Jun. 17, 1985 (17.06.85).

* cited by examiner

*Primary Examiner*—Cathy Lam
(74) *Attorney, Agent, or Firm*—Burns, Doane, Swecker & Mathis, L.L.P.

(57) ABSTRACT

There is disclosed a method of sintering cemented carbide bodies including heating said bodies to the sintering temperature in a suitable atmosphere and cooling. If said cooling at least to below 1200° C. is performed in a hydrogen atmosphere of pressure 0.4–0.9 bar cemented carbide bodies with no surface layer of binder phase are obtained. This is an advantage when said bodies are to be coated with wear resistant layers by the use of CVD-, MTCVD- or PVD-technique.

8 Claims, 4 Drawing Sheets

SINTERING METHOD

BACKGROUND OF THE INVENTION

The present invention relates to a sintering method for cemented carbide for the purpose of eliminating the binder phase layer from its surface before applying coatings on said surface.

Coated cemented carbide inserts have now for many years been commercially available for chip forming machining of metals in the metal cutting industry. Such inserts are commonly made of a metal carbide, normally WC, generally with addition of carbides of other metals such as Nb, Ti, Ta, etc. and a metallic binder phase of cobalt. By depositing onto said inserts a thin layer of a wear resistant material such as TiC, TiN, $Al_2O_3$ etc., separately or in combination, it has been possible to increase the wear resistance toughness essentially maintained.

During sintering cemented carbide inserts often obtain a completely or partly covering binder phase layer generally <1 $\mu$m thick on their surface. This particularly applies to inserts with a binder phase enrichment in the surface below the coating, so called cobalt gradient but also to inserts with even distribution of binder phase. In the latter case this layer forms on certain grades but not on other. The reason to this is not understood at present. However, the layer has a negative effect on the process when carrying out CVD- or PVD-deposition, which results in layers with inferior properties and insufficient adherence. The binder phase layer must therefore be removed before carrying out the deposition process.

It is possible to remove such binder phase layer mechanically by blasting. The blasting method is, however, difficult to control. The difficulty resides in the inability to control consistently the blasting depth with necessary accuracy, which leads to an increased scatter in the properties of the final product—the coated insert. It also results in damages to the hard constituent grains of the surface. However, in Swedish patent application 9202142-7 it is disclosed that blasting with fine particles gives an even removal of the binder phase layer without damaging the hard constituent grains.

Chemical or electrolytic methods could be used as alternatives for mechanical methods. U.S. Pat. No. 4,282,289 discloses a method of etching in a gaseous phase by using HCl in an initial phase of the coating process. In EP-A-337 696 there is proposed a wet chemical method of etching in nitric acid, hydrochloric acid, hydrofluoric acid, sulphuric acid and similar or electro-chemical methods. From JP 88-060279 it is known to use an alkaline solution, NaOH, and from JP 88-060280 to use an acid solution. JP 88-053269 discloses etching in nitric acid prior to diamond deposition. There is one drawback with these methods, namely, that they are incapable of only removing the cobalt layer. They also result in deep penetration, particularly in areas close to the edge. The etching medium not only removes cobalt from the surface but also penetrates areas between the hard constituent grains. As a result, an undesired porosity between layer and substrate is obtained at the same time as the cobalt layer may partly remain in other areas of the insert. U.S. Pat. No. 5,380,408 discloses an etching method according to which electrolytic etching is performed in a mixture of sulphuric acid and phosphoric acid. This method gives an even and complete removal of the binder phase layer without depth effect, i.e., reaching zero Co-content on the surface.

On the other hand it is in some cases not desirable to reach zero a Co-content on the surface from a coating adhesive point of view, but rather a Co surface content close to nominal content.

The above mentioned methods require additional production steps and are for that reason less attractive for production in a large scale. It would be desirable if sintering could be performed in such a way that no binder phase layer is formed or alternatively can be removed during cooling.

OBJECTS AND SUMMARY OF THE INVENTION

It is an object of this invention to avoid or alleviate the problems of the prior art.

In one aspect of the invention there is provided a method of sintering cemented carbide bodies with a composition of 4 to 15 weight % Co, up to 20 weight % cubic carbides and rest WC including heating said bodies to the sintering temperature in a suitable atmosphere and cooling whereby said cooling at least to below 1200° C. is performed in a hydrogen atmosphere of pressure 0.4–0.9 bar.

In another aspect of the invention there is provided a cemented carbide body of WC and Co with 5–10 weight % Co and an average WC grain size of 0.5–2 $\mu$m containing a 100–350 $\mu$m wide binder phase depleted surface zone in which the average binder phase content in a 25 $\mu$m surface zone is 25–75% of the nominal binder phase content, the binder phase content increases monotonously and in a non-step-wise manner without maximum up to the nominal content and the Co content on the surface is +6/−4% of the nominal Co content of the entire body.

BRIEF DESCRIPTION OF THE DRAWINGS

It is therefore an object of the present invention to provide a method of sintering cemented carbide in such a way that no binder phase layer is present on the surface after the sintering process but a well defined Co content.

DETAILED DESCRIPTION OF THE PREFERRED EMBODIMENTS OF THE INVENTION

According to the method of the present invention, the heating and high temperature steps of the sintering is performed in the conventional way. However, cooling from sintering temperature down to at least below 1200° C. is performed in a hydrogen atmosphere of 0.4 to 0.9 bar, preferably 0.5 to 0.8 bar, pressure of hydrogen. The best conditions depend on the composition of the cemented carbide, on the sintering conditions and to a certain extent on the design of the equipment used. It is within the purview of the skilled artisan to determine by experiments the optimum hydrogen pressure for which no binder phase layer is obtained and no undesired carburization of the cemented carbide is obtained. The sintering should lead to a Co content on the surface of +6/−4% relative to the nominal Co content, preferably +4/−2%. The Co content can be determined e.g. by the use of a SEM (Scanning Electron Microscope) equipped with an EDS (Energy Dispersive Spectrometer) and comparing the intensities of Co from the unknown surface and a reference, e.g. a polished section of a sample of the same nominal composition.

The method of the invention can be applied to all kinds of cemented carbides, preferably to cemented carbide with a composition of 4 to 15 weight-% Co, up to 20 weight-% cubic carbides such as TiC, TaC, NbC etc. and rest WC. Most preferably the cemented carbide has a composition 5 to 12 weight-% Co, less than 12 weight-% cubic carbides such as TiC, TaC, NbC etc. and rest WC. The average WC grain size shall be <8 μm, preferably 0.5–5 μm.

In the case of a cemented carbide body of WC and Co with 5–10 wt-% Co and an average WC grain size of 0.5–2 μm, the method according to the invention results in an about 100–350 μm, preferably 150–300 μm, wide binder phase depleted surface zone in which the binder phase content increases monotonously and in a non-step-wise manner without maximum up to the nominal content in the inner of the cemented carbide body. The average binder phase content in a 25 μm surface zone is 25–75%, preferably 40–60%, of the nominal binder phase content.

Inserts according to the invention are after sintering provided with a thin wear resistant coating including at least one layer by CVD-, MTCVD- or PVD-technique known in the art.

The invention is additionally illustrated in connection with the following Examples which are to be considered as illustrative of the present invention. It should be understood, however, that the invention is not limited to the specific details of the Examples.

EXAMPLE 1

Figure 1:
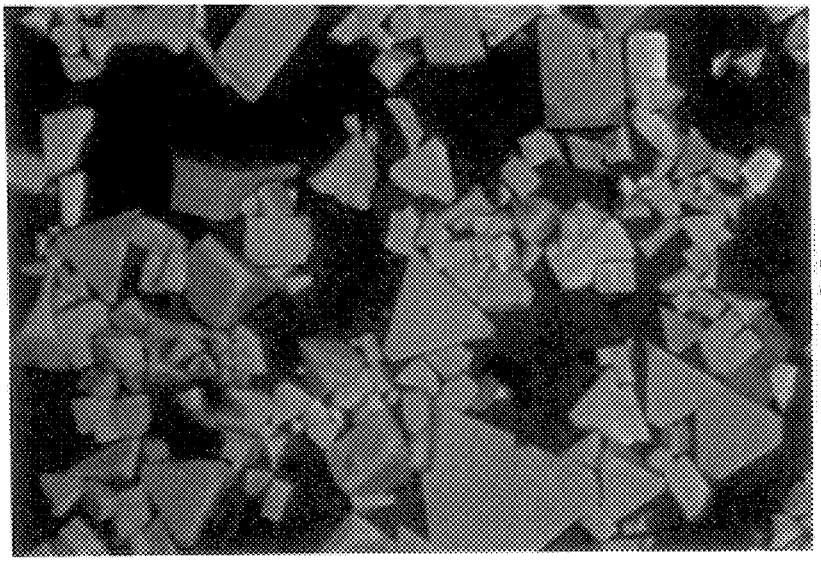
FIGS. 1, 3, 5, 6, 7 and 8 show in 3500X magnification a top view of the surface of cemented carbide inserts partly covered with a binder phase layer.

Cemented carbide inserts of type CNMG 120408 with 5.5 weight-% Co, 8.5 weight-% cubic carbides and 86 weight-% WC of 2 μm average WC-grain size were sintered in a conventional way at 1450° C. and cooled to room temperature in argon. The surface was up to 50% covered with a Co-layer, FIG. 1.

Figure 2:
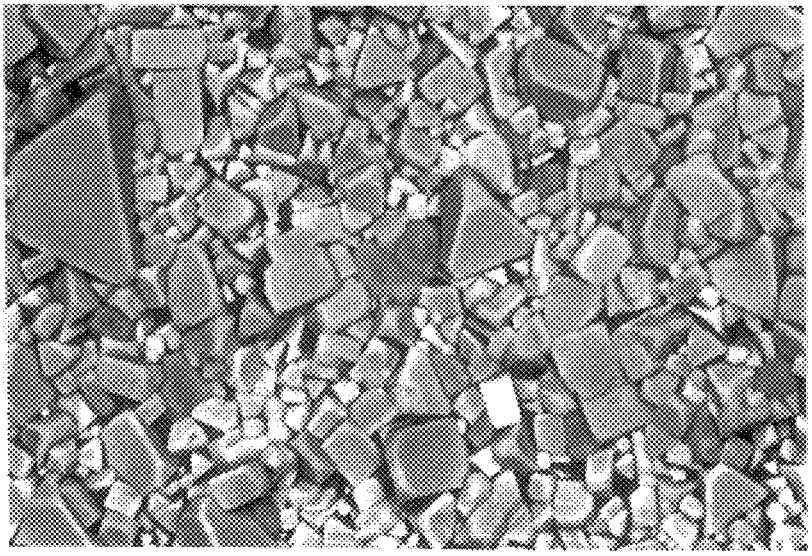
FIGS. 2, 4 and 9 show in 3500X magnification a top view of the surface of cemented carbide inserts sintered according to the invention. In these figures the dark grey areas are the Co-layer, the light grey angular grains are WC and the grey rounded grains are the so called gamma phase which is a (Ti,Ta,Nb,W)C.

Inserts of the same composition and type were sintered in the same way but cooled from 1400 to 1200° C. temperature in 0.8 bar hydrogen and from 1200° C. in pure argon atmosphere. The surface was to 6% covered with Co, which corresponds to the nominal content, FIG. 2.

EXAMPLE 2

Figure 3:
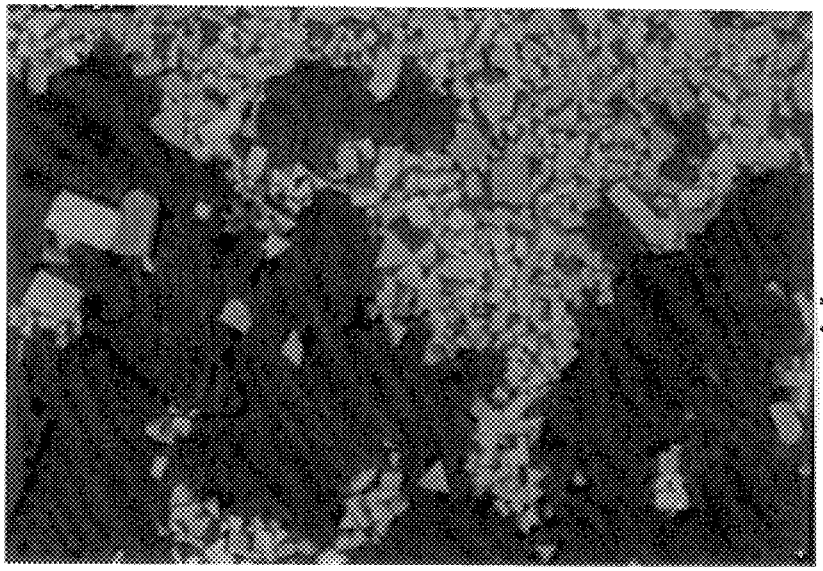

Cemented carbide inserts of type CNMG 120408 with 10 weight-% Co and 90 weight-% WC of 0.9 μm average WC-grain size were sintered in a conventional way at 1410° C. and cooled to room temperature in argon. The surface was up to 50% covered with a Co-layer, FIG. 3.

Figure 4:
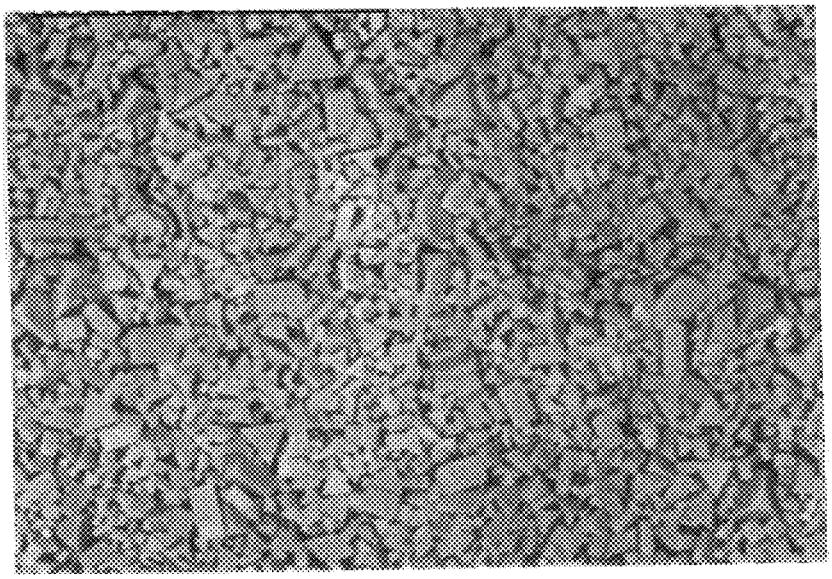

Inserts of the same composition and type were sintered in the same way but cooled from 1400 to 1200° C. temperature in 0.5 bar hydrogen and from 1200° C. in pure argon atmosphere. The surface was to about 10% covered with cobalt, which corresponds to the nominal content, FIG. 4.

EXAMPLE 3

Figure 5:
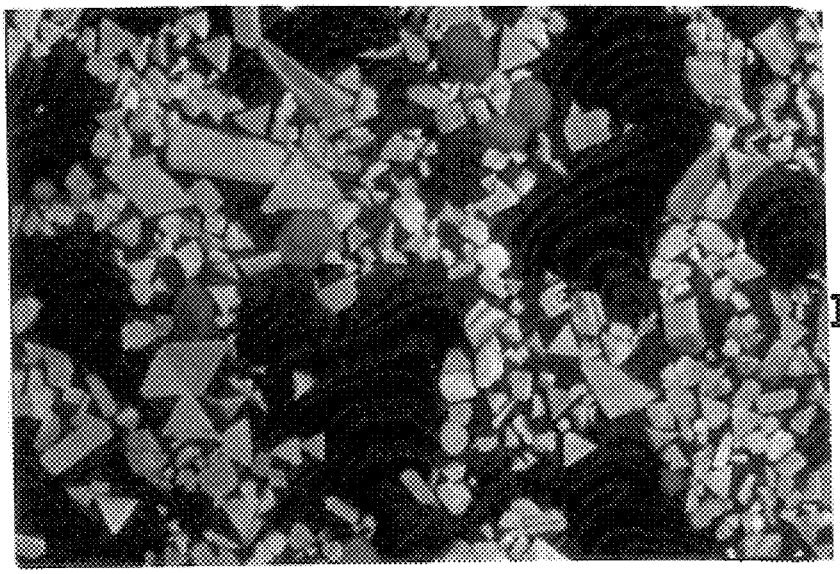

Cemented carbide inserts of type SPKN 1204 with 9.8 weight-% Co, 25.6 weight-% cubic carbides and 64.6 weight-% WC of 1.3 μm average WC-grain size were sintered in a conventional way at 1410° C. and cooled to room temperature in argon. The surface was up to about 80% covered with a Co-layer. FIG. 5.

Figure 6:
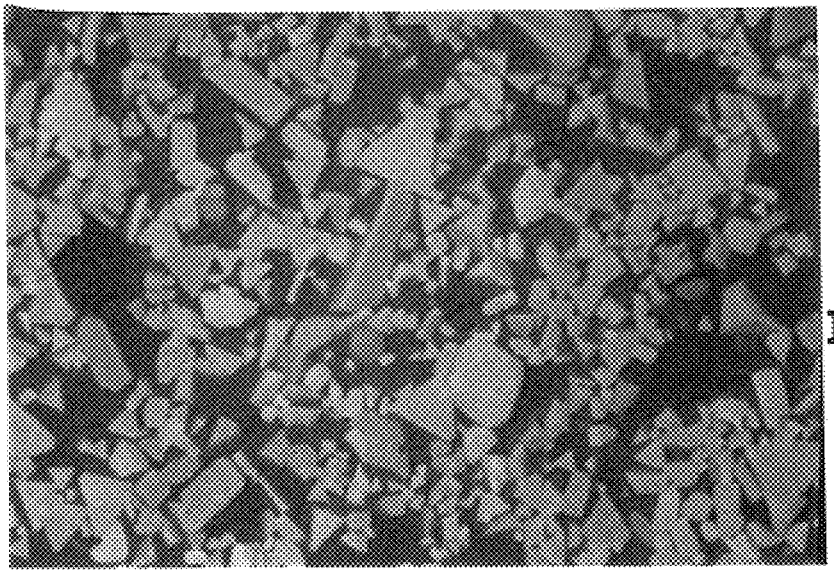

Inserts of the same composition and type were sintered in the same way but cooled from 1400 to 1200° C. temperature in 0.8 bar hydrogen and from 1200° C. in pure argon atmosphere. The surface was to about 50% covered with a Co-layer, FIG. 6.

EXAMPLE 4

Figure 7:
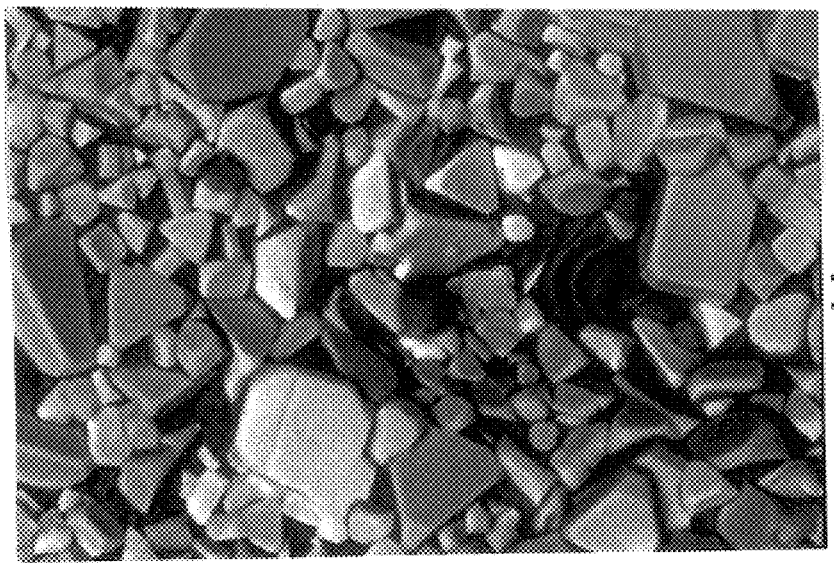

Cemented carbide inserts of type CNMG 120408 with 8 weight-% Co and 92 weight-% WC of 3 μm average WC-grain size were sintered in a conventional way at 1450° C. and cooled to room temperature in argon. The surface was up to about 20% covered with a Co-layer, FIG. 7.

Figure 8:
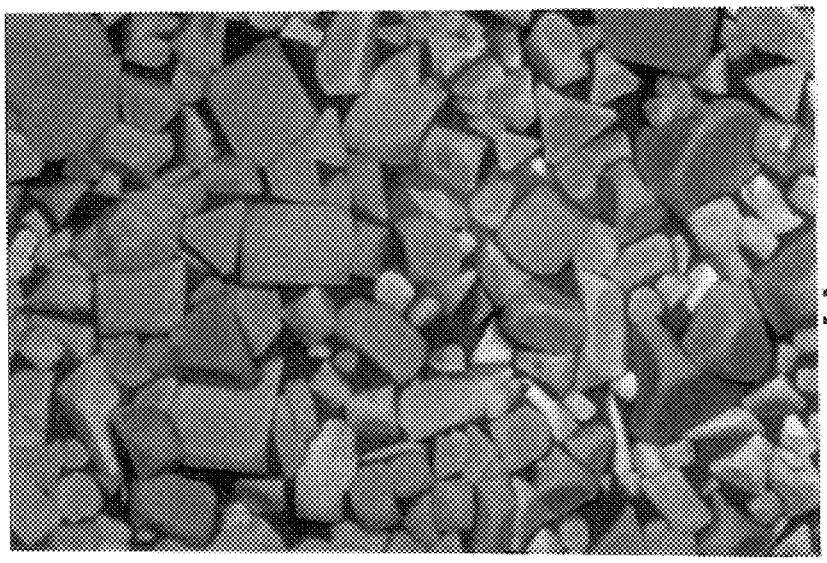

Inserts of the same composition and type were sintered in the same way but cooled from 1350 to 1250° C. temperature in 0.25 bar hydrogen and from 1250° C. in pure argon atmosphere. The surface was to about 15% covered with a Co-layer, FIG. 8.

Figure 9:
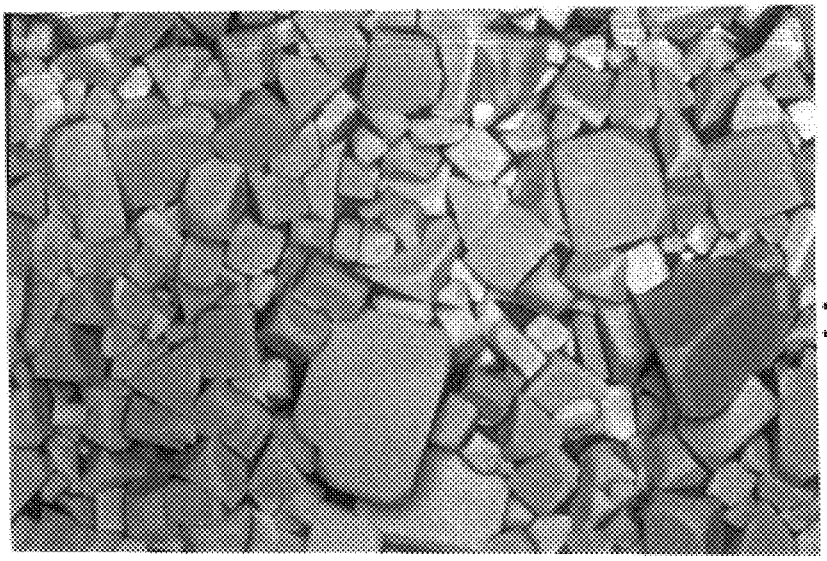

Inserts of the same composition and type were sintered in the same way but cooled from 1400 to 1200° C. temperature in 0.5 bar hydrogen and from 1200° C. in pure argon atmosphere. The surface was to less than 10% covered with Co, which corresponds to the nominal content, FIG. 9.

EXAMPLE 5

Figure 10:
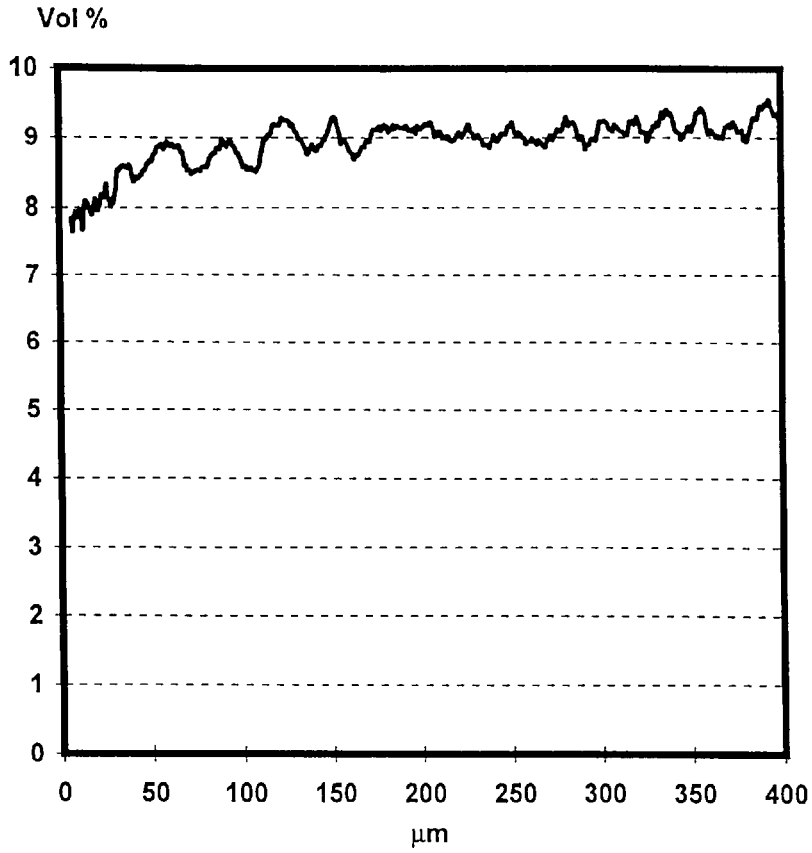
FIG. 10 shows the binder phase content in vol-% along a line perpendicular to the surface in a cemented carbide insert according to prior art and FIG. 11 in a corresponding insert according to the invention.

Cemented carbide inserts of type TCMT 110208 with 5.5 weight-% Co and 94.5 weight-% WC of 1.5 μm average WC-grain size were sintered in a conventional way at 1410° C. and cooled to room temperature in argon. The surface was up to 50% covered with a Co-layer. The binder phase distribution in a 400 μm surface zone is shown in FIG. 10.

Figure 11:
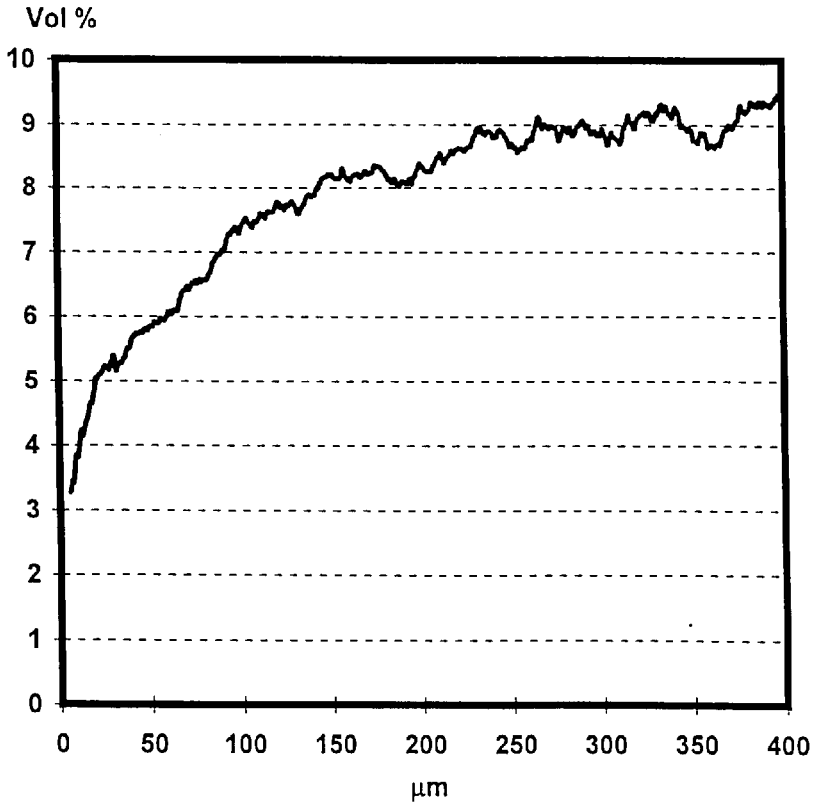

Inserts of the same composition and type were sintered in the same way but cooled from 1400 to 1200° C. temperature in 0.5 bar hydrogen and from 1200° C. in pure argon atmosphere. The surface was to about 6% covered with cobalt, which corresponds to the nominal content. The binder phase distribution in a 400 μm surface zone is shown in FIG. 11.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of sintering cemented carbide bodies with a composition of 4 to 15 weight % Co, up to 20 weight % cubic carbides and rest WC comprising heating said bodies to sintering temperature and then cooling said bodies from the sintering temperature to a temperature of 1200° C. or below in a hydrogen atmosphere at a pressure of 0.4–0.9 bar.

2. The method of claim 1 wherein said cemented carbide has the composition 5 to 12 weight-% Co, less than 12 weight-% cubic carbides and rest WC.

3. The method of claim 1 wherein said sintered bodies are provided with a thin wear resistant coating including at least one layer deposited by CVD-, MTCVD- or PVD-technique.

4. The method of claim 1 wherein cemented carbide bodies are sintered at a temperature of about 145° C.

5. A cemented carbide body having a nominal binder phase content comprising 5–10 weight % Co, WC, and an average WC grain size of 0.5–2 μm, the body comprising a 100–350 μm wide surface zone in which the average binder phase content in a 25 μm portion of the surface zone is 25–75% of the nominal binder phase content, the binder phase content in the surface zone increases monotonously and in a non-step-wise manner without maximum up to the nominal content, and the Co content on the surface of the body is +6/−4% of the nominal Co content of the entire body.

6. The cemented carbide body of claim 4 wherein the average binder phase content in the 25 μm portion of the surface zone is 40–60% of the nominal binder phase content.

7. The cemented carbide body of claim 4 wherein the Co content on the surface of the body is +4/−2% of the nominal Co-content of the entire body.

8. A method of producing a cemented carbide body, the cemented carbide body comprising hard constituents and a nominal binder phase content, the method comprising:

providing the body with a composition wherein the hard constituents comprise WC, the binder phase comprises 4–15 weight % Co, and comprising up to 20 weight % cubic carbides;

heating the body to sintering temperature; and cooling the body to a temperature of 1200° C. or below in a hydrogen atmosphere at a pressure of 0.4–0.9 bar thereby providing the body with a surface having a Co content approximately equal to the nominal Co content of the body.

* * * * *